US007182420B2

(12) United States Patent
Nakazawa

(10) Patent No.: US 7,182,420 B2
(45) Date of Patent: Feb. 27, 2007

(54) INK CONCENTRATION DETECTING METHOD AND INK JET RECORDING APPARATUS

(75) Inventor: Yusuke Nakazawa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 304 days.

(21) Appl. No.: 10/995,378

(22) Filed: Nov. 24, 2004

(65) Prior Publication Data

US 2005/0116970 A1 Jun. 2, 2005

(30) Foreign Application Priority Data

Nov. 28, 2003 (JP) ..... 2003-398896

(51) Int. Cl.
*B41J 2/195* (2006.01)

(52) U.S. Cl. ..... 347/7

(58) Field of Classification Search ..... 347/7, 347/19

See application file for complete search history.

(56) References Cited

U.S. PATENT DOCUMENTS 6,145,954 A * 11/2000 Moore ..... 347/28
6,164,760 A 12/2000 Mizoguchi et al.

FOREIGN PATENT DOCUMENTS

JP 2834100 B2 10/1989

* cited by examiner

*Primary Examiner*—Stephen Meier
*Assistant Examiner*—Jason Uhlenhake
(74) *Attorney, Agent, or Firm*—Sughrue Mion, PLLC

(57) ABSTRACT

An ink concentration detecting method and recording apparatus cause one of a cleaning liquid and ink of known ink concentration to flow through an ink passage through which the ink is to flow, detect a first ink concentration in the ink passage in an operation state in which ink of predetermined ink concentration flows through the ink passage, and detect a second ink concentration in the ink passage after the cleaning liquid is caused to flow through the ink passage to clear the ink passage or in a state in which the ink of known ink concentration is caused to flow through the ink passage. The method and apparatus detect ink concentration in the ink passage in the operation state based on the first ink concentration and the second ink concentration. Precise ink concentration of the ink to be supplied to an ink jet head is obtained.

7 Claims, 6 Drawing Sheets

INK CONCENTRATION DETECTING METHOD AND INK JET RECORDING APPARATUS

This application claims priority on Japanese patent application No. 2003-398896, the entire contents of which are hereby incorporated by reference. In addition, the entire contents of literatures cited in this specification are incorporated by reference.

BACKGROUND OF THE INVENTION

The present invention relates in general to a method of detecting ink concentration and ink jet recording apparatus, and more particularly to a method and recording apparatus of detecting ink concentration of ink to be supplied to an ink jet head.

An electrostatic ink jet recording system is known as a kind of ink jet recording system for ejecting ink towards a recording medium to record a desired image on the recording medium.

In the electrostatic ink jet recording system, used as ink is an ink composition which is obtained by dispersing charged color particles into a dispersion medium (hereinafter referred to as "ink" for short), and the ink is supplied from an ink tank to an ink jet head to be ejected in the form of minute ink droplets from a large number of ejection portions formed in the ink jet head. When the ink is ejected from the large number of ejection portions, predetermined voltages are respectively applied to electrodes provided in each of the ejection portions of the ink jet head. As a result, electrostatic forces are generated in the ejection portions. Then, the color particles contained in the ink are highly concentrated in the ejection portion by the electrostatic force, and an ink droplet containing the highly concentrated color particles is flown towards a recording medium to strike on the recording medium. In such a manner, a desired image is recorded on the recording medium.

In the electrostatic ink jet recording system, as described above, the color particles contained in the ink are highly concentrated in the ejection portion by the electrostatic force. Hence, repeated ejection of the ink reduces an amount of color particles contained in the ink. When an amount of charged color particles within the ink decreases, there is a fear that the color particles are hardly highly concentrated by the electrostatic force, which reduces a frequency at which the ink droplet is ejected from the ejection opening, making it impossible to form a desired image. In order to avoid such a situation, normally, an ink tank is suitably replenished with high concentration ink so that the ink concentration becomes constant.

Examples of a recording apparatus in which ink concentration is detected and an ink tank is replenished with high concentration ink based on the detected ink concentration include an electrostatic ink jet recording apparatus disclosed in JP 2,834,100 B, in which an amount of toner particles contained in ink passing through a pipe is detected by magnetic or optical means, it is judge whether or not the amount of toner particles is enough to realize the sufficient printing concentration, and an ink tank is replenished with the toner particles when the amount of toner particles is less, i.e., is not enough to realize the sufficient printing concentration.

However, in the recording apparatus including a device for detecting ink concentration, a component such as a detection element or a detection cell used to detect the ink concentration contacts ink. Thus, the ink is adhered to such components, and for example, after a long period of time has elapsed, the color particles contained in the ink are firmly adhered to such components. As a result, a problem arises in that even though the ink concentration is actually low, the detected ink concentration is higher than the actual ink concentration by an amount of color particles firmly adhered to an inner wall of the detection cell. When a difference occurs between the actual ink concentration and the detected value obtained by the detection element, it becomes impossible to form an image on the recording medium at desired concentration, and thus the image quality is reduced.

SUMMARY OF THE INVENTION

The present invention has been made in order to solve the above-mentioned problems, and it is, therefore, an object of the present invention to provide an ink concentration detecting method which is capable of detecting simply and precisely ink concentration of ink to be supplied to an ink jet head.

It is another object of the present invention to provide an ink jet recording apparatus which is capable of precisely detecting ink concentration to form an image at desired concentration.

In order to attain the above-mentioned objects, a first aspect of the present invention provides an ink jet recording apparatus, including: ink jet ejecting means for ejecting ink containing charged color particles towards a recording medium by an electrostatic force; ink supplying means for supplying the ink to the ink jet ejecting means; detection means for detecting ink concentration as concentration of the color particles, the detection means being provided in an ink passage of the ink; and ink concentration correcting means for correcting a detected value in an operation state in the ink passage obtained by the detection means based on one of a detected value obtained in a cleaning state in the ink passage using a cleaning liquid and a detected value obtained in a using state in which ink of known ink concentration is used.

In the ink jet recording apparatus of the present invention, preferably, the detected value obtained in the cleaning state is a detected value obtained by the detection means when the cleaning liquid is caused to flow through the ink passage or after the cleaning liquid is caused to flow through the ink passage, and the detected value obtained in the using state in which the ink of known ink concentration is used is a detected value obtained by the detection means when the ink of known ink concentration is caused to flow through the ink passage in ink exchange.

In addition, preferably, the ink jet recording apparatus of the present invention further includes cleaning means for cleaning the ink passage using the cleaning liquid.

In the ink jet recording apparatus of the present invention, preferably, the ink of known concentration is one of fresh ink of predetermined concentration which is to be caused to flow in ink exchange and a diluted liquid of low ink concentration, and the cleaning liquid is one of a carrier liquid for the color particles contained in the ink and a diluted liquid containing no color particle.

In the ink jet recording apparatus of the present invention, preferably, the detection means optically detects the ink concentration in the ink passage.

Also, in the ink jet recording apparatus of the present invention, preferably, the ink flow path is formed of a tubular member, and the detection means optically detects the ink concentration in the ink passage from outside the tubular member.

In addition, a second aspect of the present invention provides an ink concentration detecting method in which concentration of ink containing charged color particles and supplied to an ink jet head for ejecting the ink towards a recording medium by an electrostatic force is detected, including the steps of: causing one of a cleaning liquid and ink of known ink concentration to flow through an ink passage through which the ink is to flow; detecting a first ink concentration in the ink passage in an operation state in which ink of predetermined ink concentration flows through the ink passage; detecting a second ink concentration in the ink passage after the cleaning liquid is caused to flow through the ink passage to clear the ink passage or in a state in which the ink of known ink concentration is caused to flow through the ink passage; and detecting ink concentration in the ink passage in the operation state based on the first ink concentration and the second ink concentration.

According to the ink concentration detecting method of the present invention, the concentration component due to color particles firmly adhered to the ink passage is obtained, and the ink concentration detected from the ink passage is corrected based on the concentration component due to color particles firmly adhered to the ink passage. Hence, the ink concentration of the ink flowing in the ink passage can be always precisely determined.

According to the ink jet recording apparatus of the present invention, the ink concentration of the ink in the ink passage in the operation state is detected by the ink concentration correcting means, and the detected value obtained in the operation state is corrected based on one of the detected value obtained in the cleaning state and the detected value obtained in the state in which the ink of known ink concentration is used. Hence, the ink concentration of the ink flowing in the ink passage can be precisely determined. Thus, the ink concentration of the ink to be supplied to the ink jet head can be precisely controlled. As a result, it becomes possible to always stably eject the ink of constant concentration from the ink jet head for a long period of time, which results in stable recording of high-quality image for a long period of time.

In addition, according to the ink jet recording method of the present invention, the ink concentration of the ink to be supplied to the ink jet head is adjusted based on the ink concentration detected by utilizing the ink concentration detecting method of the present invention. Hence, the recording can be always carried out at constant ink concentration. As a result, an image of extremely high image quality can be formed stably on a recording medium for a long period of time.

DETAILED DESCRIPTION OF THE PREFERRED EMBODIMENT

The ink concentration detecting method of the present invention will hereinafter be described in detail based on a preferred embodiment shown in the accompanying drawings.

Figure 1:
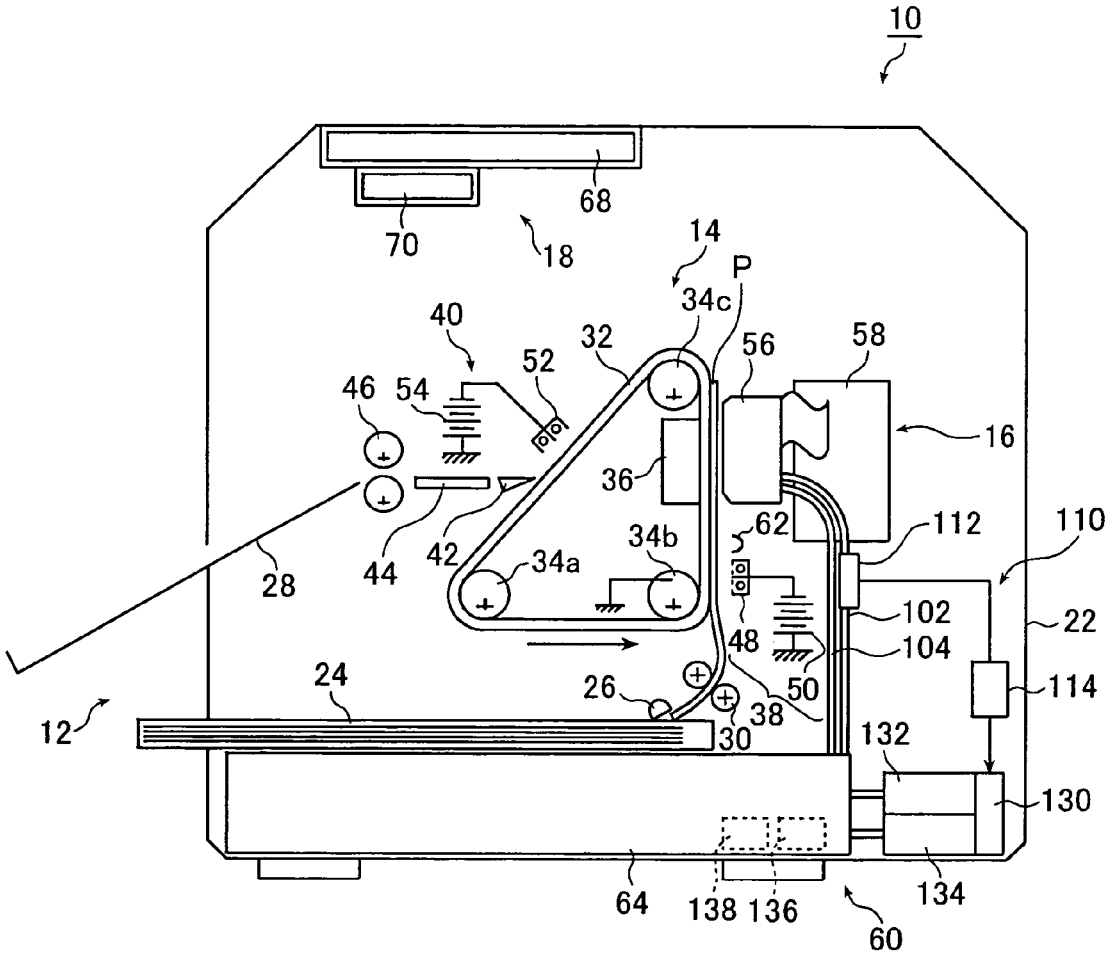
FIG. 1 is a schematic constructional view of an ink jet recording apparatus according to the present invention.

First, an ink jet recording apparatus in which the ink concentration detecting method of the present invention is implemented will be described below by referring to FIG. 1. FIG. 1 is a schematic constructional view of an electrostatic ink jet recording apparatus according to an embodiment of the present invention. An electrostatic ink jet recording apparatus 10 of the present invention shown in FIG. 1 is an ink jet recording apparatus for recording a full-color image on a recording medium (recording sheet) P through the four-color printing process by controlling ejection of ink containing charged fine particles using an electrostatic force. The ink jet recording apparatus 10 includes holding means 12 for holding the recording medium P, conveyance means 14, recording means 16, solvent collecting means 18, a casing 22, and an ink concentration detecting device 110.

The holding means 12 for holding the recording medium P includes a sheet feeding tray 24 for holding the recording medium P before the recording, a feed roller 26, and a sheet discharging tray 28 for holding the recording media P after completion of the recording.

A front end portion of the sheet feeding tray 24 is inserted into the inside of an installation portion for the sheet feeding tray 24 (provided on a lower portion on the left-hand side of the casing 22 in the figure). In this connection, the sheet feeding tray 24 is detachably inserted into a predetermined position of the installation portion. In a state in which the sheet feeding tray 24 is perfectly installed in the installation portion, the front end portion of the sheet feeding tray 24 in an insertion direction contacts an inner end portion of the installation portion, and a rear end portion of the sheet feeding tray 24 projects outside from the casing 22. In addition, the feed roller 26 is disposed in the vicinity of an inner portion of the installation portion for the sheet feeding tray 24.

A plurality of sheets of recording medium P before the recording are stocked on top of one another within the sheet feeding tray 24. In recording an image, the recording medium P is taken out one by one from the sheet feeding tray 24 by the feed roller 26 to be supplied to the conveyance means 14 for the recording medium P.

The discharge tray 28 is disposed in the vicinity of a discharge portion for the recording medium P (corresponding to a central portion on the left-hand side of the casing 22 in the figure) so that a front end portion side (toward which the recording medium P is conveyed) is located outside the casing 22, and a rear end portion thereof is located inside the casing 22. In addition, the discharge tray 28 is disposed at a predetermined inclination angle with a horizontal line so that the front end portion thereof is lower in position than the rear end portion thereof.

The recording medium P after completion of the recording is conveyed by the conveyance means 14 to be discharged through the discharge portion, and are then successively stocked on top of one another within the discharge tray 28.

Subsequently, the conveyance means 14 for the recording medium P will be described.

The conveyance means 14 is means for electrostatically attracting the recording medium P to convey the recording medium P along a predetermined path from the sheet feeding tray 24 to the discharge tray 28. The conveyance means 14 includes a conveyance roller pair 30, a conveyance belt 32, belt rollers 34*a*, 34*b*, and 34*c*, an electrically conductive platen 36, a charger 38 and a discharger 40 for the recording medium P, a separation claw 42, a guide 44, and a fixing roller pair 46.

The conveyance roller pair 30 is provided in a position between the feed roller 26 and the conveyance belt 32 on the conveyance path for the recording medium P.

The recording medium P taken out from the sheet feeding tray 24 by the feed roller 26 is held and conveyed by the conveyance roller pair 30 to be supplied to a predetermined position on the conveyance belt 32.

The charger 38 for the recording medium P includes a scorotron charger 48 and a negative high voltage power source 50. The scorotron charger 48 is disposed in a position between the conveyance roller pair 30 and the recording means 16 along the conveyance path for the recording medium P, i.e., in a position facing the surface of the conveyance belt 32 in a position to which the recording medium P is supplied by the conveyance roller pair 30. In addition, a negative side terminal of the negative high voltage power source 50 is connected to the scorotron charger 48, and a positive side terminal of the negative high voltage power source 50 is grounded.

The surface of the recording medium P is uniformly charged at a predetermined negative high voltage by the scorotron charger 48 connected to the negative high voltage power source 50, and thus is in a state of being always biased at a given D.C. bias voltage (e.g., about −1.5 kV). As a result, the recording medium P is electrostatically attracted to the surface of the conveyance belt 32 having an insulation property.

The conveyance belt 32 is a ring-shaped endless belt, and is stretched in a triangular shape around the three belt rollers 34*a*, 34*b*, and 34*c*. In addition, the flat plate-like conductive platen 36 is disposed in an inner portion of the conveyance belt 32 corresponding to a position facing the recording means 16.

A face of the conveyance belt 32 on which the recording medium P is to be electrostatically attracted (front side) has the insulation property, and a face of the conveyance belt 32 adapted to contact the belt rollers 34*a*, 34*b*, and 34*c* (rear side) has the conduction property. The belt roller 34*b* is grounded, and hence the belt rollers 34*a* and 34*c*, and the conductive platen 36 are also grounded through the rear surface of the conveyance belt 32. As a result, a portion of the conveyance belt 32 located in a position facing the recording means 16 functions as a counter electrode of the ink jet head.

At least one of the belt rollers 34*a*, 34*b*, and 34*c* is connected to a drive source (not shown), and is driven and rotated at a predetermined speed during the recording. As a result, during the recording, the conveyance belt 32 is moved in a direction indicated by an arrow in the figure. Consequently, as the conveyance belt 32 moves, the recording medium P is moved to be conveyed while the recording medium P faces the recording means 16.

The discharger 40 for the recording medium P includes a corotron discharger 52 and a high voltage power source 54. The corotron discharger 52 is disposed in a position between the recording means 16 and the separation claw 42 along the conveyance path for the recording medium P, i.e., in a position facing the surface of the conveyance belt 32 corresponding to a position to which the recording medium P after completion of the recording is conveyed. In addition, one terminal of the high voltage power source 54 is connected to the corotron discharger 52, and the other terminal of the high voltage power source 54 is grounded.

The electric charges on the recording medium P after completion of the recording are discharged by the corotron discharger 52 connected to the high voltage power source 54. As a result, the recording medium P becomes easy to be separated from the conveyance belt 32.

In addition, the separation claw 42, the guide 44, and the fixing roller pair 46 are disposed in this order on a downstream side of the discharger 40 along the conveyance path for the recording medium P.

The recording medium P the electric charges on which have been discharged by the discharger 40 is separated from the conveyance belt 32 by the separation claw 42 to be supplied to the fixing roller pair 46 along the guide 44. The fixing roller pair 46 is a pair of rollers including a heat roller. An image recorded on the recording medium P is fixed through the contact and the heating while the recording medium P is held and conveyed by the fixing roller pair 46. The recording medium P after completion of the fixation is discharged through the discharge portion to be successively stocked on top of one another within the discharge tray 28.

Subsequently, the recording means 16 for the recording medium P will be described.

The recording means 16 records a full-color image on the recording medium P with the electrostatic force through the four-color printing. The recording means 16 includes an ink jet head 56, a head driver 58, an ink circulation system 60 and a position detector 62 for detecting a position of the recording medium P on the conveyance path.

The ink jet head 56 is a full line head which is capable of recording an image for one row at a time. The ink jet head 56 includes ejection heads of four colors of cyan (C), magenta (M), yellow (Y), and black (B) for recording a full-color image.

FIGS. 2–4C each show a concrete head construction of an ejection head for each color in the electrostatic ink jet head 56 of a system in which the ejection of the ink containing the charged color fine particles is controlled by the electrostatic force.

Figure 2:
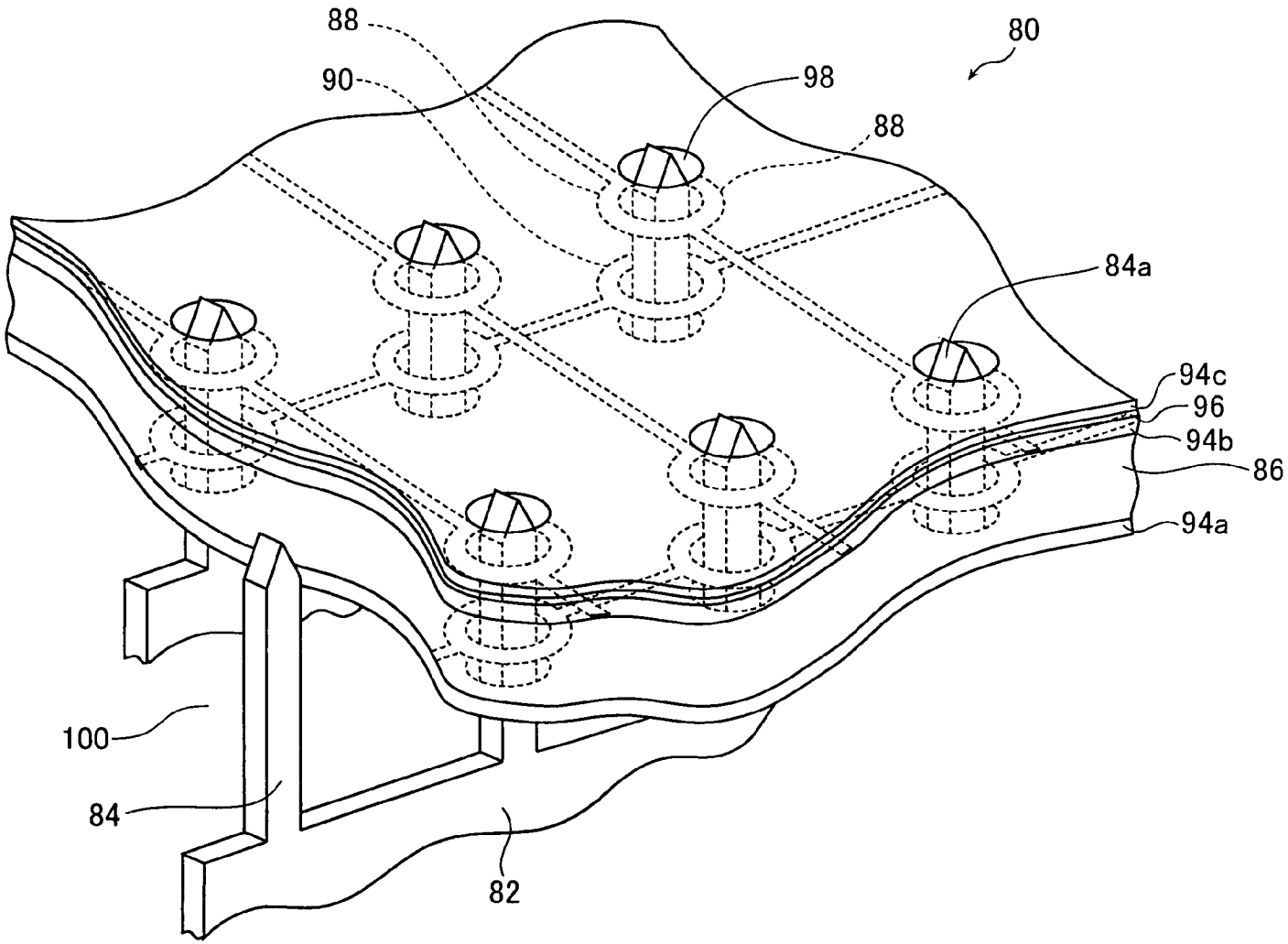
FIG. 2 is a perspective view schematically showing a part of a cross section of a head main portion of an ink jet head used in the ink jet recording apparatus shown in FIG. 1.
Figure 3A:
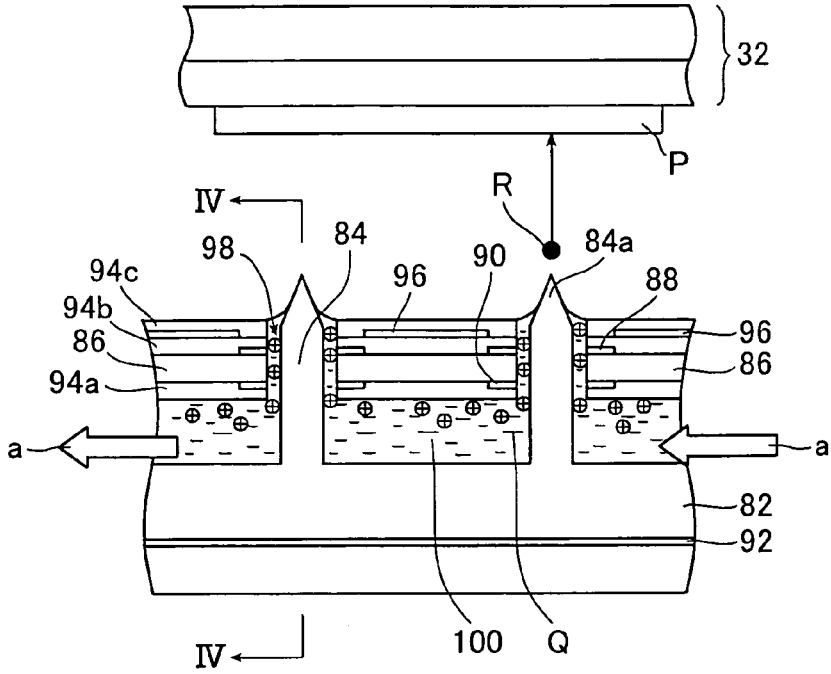
FIG. 3A is a partial schematic cross sectional view of the head main portion of the ink jet head used in the ink jet recording apparatus shown in FIG. 1.
Figure 3B:
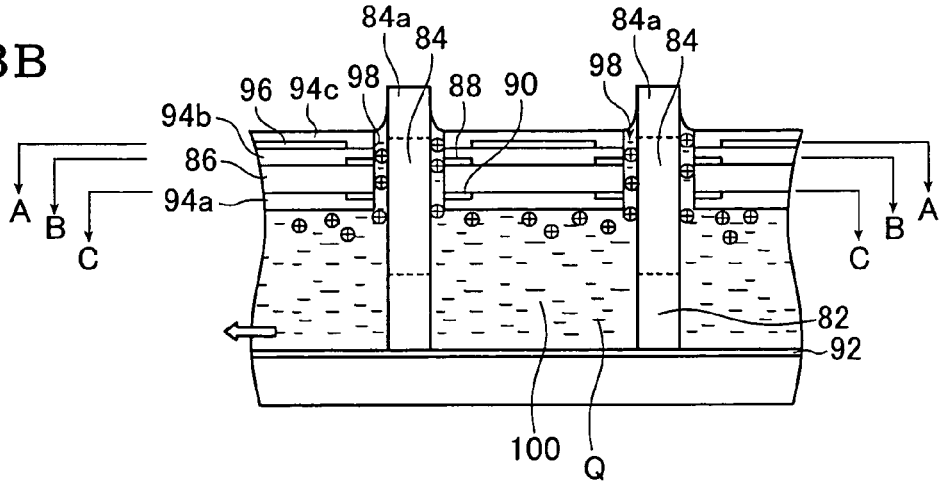
FIG. 3B is a schematic cross sectional view taken along line IV—IV of FIG. 3A.
Figure 4A:
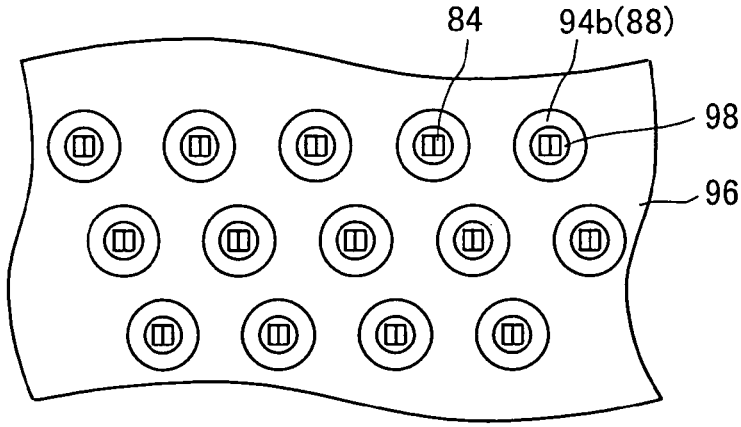
FIG. 4A is a cross sectional view taken along line A—A of FIG. 3B.
Figure 4B:
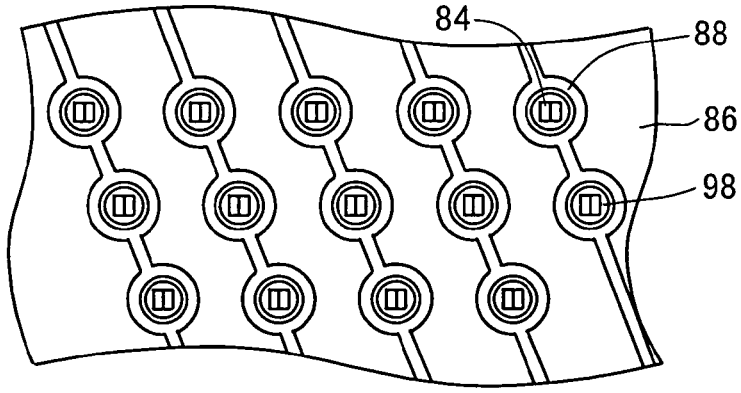
FIG. 4B is a cross sectional view taken along line B—B of FIG. 3B.
Figure 4C:
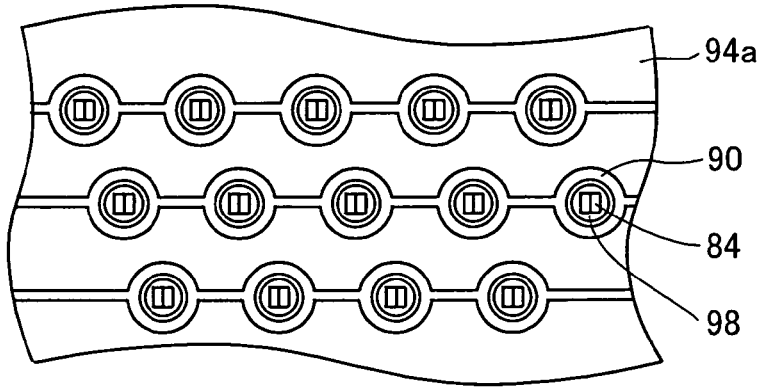
FIG. 4C is a cross sectional view taken along line C—C of FIG. 3B.

FIG. 2 is a partial schematic perspective view showing an example construction of an ejection head 80 for each color used for the ink jet head 56 shown in FIG. 1. FIG. 3A is a schematic cross-sectional view showing a part of the ejection head 80 shown in FIG. 2. FIG. 3B is a schematic cross-sectional view taken along line IV—IV in FIG. 3A. FIGS. 4A, 4B, and 4C are arrow views each taken along line A—A, line B—B, and line C—C in FIG. 3B (through hole portions are viewed from upper side).

The ejection head 80 shown in these drawings is an electrostatic ink jet head having control electrodes of a two-layered electrode structure and records an image corresponding to image data on the recording medium P by ejecting ink Q containing color fine particles, such as charged pigments (e.g., toner fine particles), by means of an electrostatic force. For this purpose, the ejection head 80 includes a head substrate 82, ink guides 84, an insulative substrate 86, first control electrodes 88 and second control electrodes 90 constituting control electrodes, and a floating conduction plate 92. The ejection head 80 having this construction is arranged so as to oppose the transport belt 32 that supports the recording medium P serving as a counter electrode.

In the ejection head 80 of the illustrated example, the control electrodes form a two-layered electrode structure where the insulative substrate 86 is sandwiched between the first control electrodes 88 arranged on the upper surface of the insulative substrate 86 and the second control electrodes 90 arranged on the lower surface thereof in the drawings.

The ejection head 80 of the illustrated example also includes an insulation layer 94*a* covering the lower side (lower surfaces) of the second control electrodes 90, an insulation layer 94*b* covering the upper side (upper surfaces) of the first control electrodes 88, a sheet-like guard electrode 96 arranged on the upper side of the first control electrodes 88 with the insulation layer 94*b* in between, and an insulation layer 94*c* covering the upper surface of the guide electrode 84.

In the ejection head 80 of the illustrate example, each ink guide 84 is made of an insulative resin flat plate having a predetermined thickness and having a projection-like tip end portion 84*a*. Each ink guide 84 is arranged on the head substrate 82 at the position of each ejection portion. Further, in a layered product of the insulation layer 94*a*, the insulative substrate 86, and the insulation layers 94*b* and 94*c*, through holes 98 are established at positions corresponding to the arrangement of the ink guides 84. The ink guides 84 are inserted into the through holes 98 from the insulation layer 94*a* side so that the tip end portions 84*a* of the ink guides 84 project from the insulation layer 94*c*. Note that a slit serving as an ink guide groove may be formed in the tip end portion 84*a* of each ink guide 84 in the top-bottom direction on the paper plane of the drawing, thereby promoting supply of the ink Q and concentration of the charged color fine particles in the ink Q to the tip end portion 84*a*.

The tip end portion 84*a* of each ink guide 84 is formed in an approximately triangular shape (or an approximately trapezoid shape) that is gradually narrowed toward the recording medium P (transport belt 32) side. Also, it is preferable that a metal be vapor-deposited on the tip end portion (extreme tip end portion) 84*a* of each ink guide 84 from which the ink Q is to be ejected. Although there occurs no problem even if the metal vapor-deposition is not carried out for the tip end portion 84*a* of the ink guide 84, it is preferable that the metal vapor-deposition be conducted because the effective dielectric constant of the tip end portion 84*a* of the ink guide 84 becomes large as a result of the metal vapor-deposition and there is provided an effect that it becomes easy to generate an intense electric field. Note that the shape of the ink guides 84 is not specifically limited so long as it is possible to concentrate the ink Q (in particular, the charged color particles in the ink Q) in the tip end portions 84*a* through the through holes 98 of the insulative substrate 86. For instance, the shape of the tip end portions 84*a* may be changed as appropriate into a shape other than the projection, such as a conventionally known shape.

The head substrate 82 and the insulation layer 94*a* are arranged so as to be spaced apart from each other by a predetermined distance, and an ink flow path 100 functioning as an ink reservoir (ink chamber) for supplying the ink Q to the ink guides 84 is formed between the head substrate 82 and the insulation layer 94*a*. Note that the ink Q in the ink flow path 100 contains color fine particles charged to the same polarity as the voltages applied to the first control electrodes 88 and the second control electrodes 90, and is circulated in a predetermined direction (in the example shown in FIGS. 3A and 3B, in the direction of arrow "a" from the right to the left) in the ink flow path 100 at a predetermined speed (ink flow of 200 mm/s, for instance) by the ink circulation system 60 (see FIG. 1) at the time of recording. Hereinafter, a case where the color fine particles in the ink are positively charged will be described as an example.

As shown in FIG. 2, the first control electrodes 88 and the second control electrodes 90 are arranged for each ejection portion on the upper surface of the insulative substrate 86 and the lower surface thereof, respectively, and they are ring-shaped or circular electrodes surrounding the through holes 98 bored in the insulative substrate 86. Note that the first control electrodes 88 and the second control electrodes 90 are not limited to the circular electrodes and may be changed into approximately circular electrodes, division-circular electrodes, parallel electrodes, or approximately parallel electrodes. The first control electrodes 88 and the second control electrodes 90, a part of which have the shape described above, are arranged in a matrix shape and form the two-layered electrode structure. Here, the multiple first control electrodes 88 are connected to each other in a row direction (main scanning direction, for instance) and the multiple second control electrodes 90 are connected to each other in a column direction (sub scanning direction, for instance).

When the first control electrodes 88 in one row are set at a high-voltage level or under a floating (high-impedance) state and the second control electrodes 90 in one column are set at a high-voltage level, that is, when both of one row and one column of the electrodes are set under an on-state, one ejection portion existing at an intersection of the row and the column is set under an on-state and ejects the ink. Note that ink ejection is not performed when one of the first control electrodes 88 and the second control electrodes 90 are set at a ground level. In this manner, the first control electrodes 88 and the second control electrodes 90 arranged in a matrix manner are matrix-driven. Accordingly, it becomes possible to significantly reduce the number of drivers 58 (see FIG. 1) for driving the first control electrodes 88 and second control electrodes 90, to miniaturize the head driver 58, and to reduce its implementation area.

Meanwhile, the recording medium P charged to a voltage having a polarity that is opposite to the polarity of the charged color fine particles in the ink is arranged so as to oppose the ink guides 84 while being held on the transport belt 32. As described above, in this embodiment, the recording medium P is charged to a negative high voltage. Also, the front surface of the transport belt 32 holding the recording medium P is an insulative fluororesin surface and the back surface thereof is a conductive metallic surface, with the metallic surface being grounded through the conductive belt roller 34*b* (see FIG. 1).

The floating conduction plate 92 is arranged below the ink flow path 100 and is set under an electrically insulated state (high-impedance state). In the illustrated example, the floating conduction plate 92 is arranged within the head substrate 82.

At the time of recording of an image, the floating conduction plate 92 generates an induced voltage in accordance with the value of a voltage applied to each ejection portion and causes the color fine particles in the ink Q in the ink flow path 100 to migrate to the insulative substrate 86 side and to be concentrated in the ink Q. Accordingly, it is required that the floating conduction plate 92 is arranged on the head substrate 82 side with respect to the ink flow path 100. Also, it is preferable that the floating conduction plate 92 be arranged on an upstream side of the ink flow path 100 with respect to the position of the ejection portion. With this floating conduction plate 92, the concentration of the charged color fine particles in the upper layer in the ink flow path 100 is increased. As a result, it becomes possible to increase the concentration of the charged color fine particles in the ink Q passing through the through holes 98 to a predetermined level, to cause the charged color fine particles to be concentrated in the tip end portions 84*a* of the ink guides 84, and to maintain the concentration of the charged color fine particles in the ink Q ejected as ink droplets R at a predetermined level.

In the ejection head 80 of this embodiment including the control electrodes of the two-layered electrode structure described above, the second control electrodes 90 always receive application of a predetermined voltage (600 V, for instance) and the first control electrodes 88 are switched between a ground state (off-state) and a high-impedance state (on-state) in accordance with image data, for instance. By doing so, ejection/non-ejection of the ink Q (ink droplets R) containing the color fine particles charged to the same polarity as the high-voltage level applied to the second control electrodes 90 is controlled. That is, in the ejection head 80, when one of the first control electrodes 88 is set at the ground level (off-state), the electric field strength in proximity to the tip end portion 84*a* of an corresponding ink guide 84 remains low and ejection of the ink Q from the tip end portion 84*a* of the ink guide 84 is not performed. On the other hand, when one of the first control electrodes 88 is set under the high-impedance state (on-state), the electric field strength in proximity to the tip end portion 84*a* of the corresponding ink guide 84 is increased and the ink Q concentrated in the tip end portion 84*a* of the ink guide 84 is ejected from the tip end portion 84*a* by means of an electrostatic force. When doing so, it is also possible to further concentrate the ink Q by selecting the condition.

In such a two-layered electrode structure, the first control electrodes 88 are switched between the high-impedance state and the ground level, so that no large electric power is consumed for the switching. Therefore, according to this embodiment, even in the case of an ink jet head that needs to perform high-definition recording at a high speed, it becomes possible to significantly reduce power consumption.

It should be noted here that the ejection/non-ejection may be controlled by switching the first control electrodes 88 between the ground level (off-state) and the high-voltage level (on-state) in accordance with image data. In the ejection head 80 of this embodiment, when one of the first control electrodes 88 and the second control electrodes 90 are set at the ground level, the ink ejection is not performed and, only when the first control electrodes 88 are set under the high-impedance state or at the high-voltage level and the second control electrodes 90 are set at the high-voltage level, the ink ejection is performed.

Also, in this embodiment, pulse voltages may be applied to the first control electrodes 88 and the second control electrodes 90 in accordance with image signals and the ink ejection may be performed when both of these electrodes are set at the high-voltage level.

It should be noted here that it does not matter whether the ink ejection/non-ejection is controlled using one or both of the first control electrodes 88 and the second control electrodes 90. However, preferably when one of the first control electrodes 88 and the second control electrodes 90 are set at the ground level, the ejection of the ink Q is not performed and, only when the first control electrodes 88 are set under the high-impedance state or at the high-voltage level and the second control electrodes 90 are set at the high-voltage level, the ink ejection is performed.

Also, the recording medium P may be charged to −1.6 kV, for instance, and the ink ejection may be controlled so that the ink will not be ejected when at least one of the first control electrodes 88 and the second control electrodes 90 are set at a negative high voltage (−600 V, for instance) and the ink will be ejected only when both of the first control electrodes 88 and the second control electrodes 90 are set at the ground level (0V).

Also, according to this embodiment, the ejection portions are arranged in a two-dimensional manner and are matrix-driven, so that it becomes possible to significantly reduce the number of row drivers for driving multiple ejection portions in the row direction and the number of column drivers for driving multiple ejection portions in the column direction. Therefore, according to this embodiment, it becomes possible to significantly reduce the implementation area and power consumption of a circuit for driving the two-dimensionally arranged ejection portions. Also, according to this embodiment, it is possible to arrange the ejection portions while maintaining relatively large margins, so that it becomes possible to extremely reduce a danger of discharging between the ejection portions and to cope with both of high-density implementation and high voltage driving with safety.

It should be noted here that in the case of an ejection head, such as the electrostatic ejection head 80 described above, that uses control electrodes of the two-layered electrode structure composed of the first control electrodes 88 and the second control electrodes 90, when the ejection portions are arranged at a high density, an electric field interference may occur between adjacent ejection portions. Therefore, it is preferable that, like in this embodiment, the guard electrode 96 be provided between the first control electrodes 88 of adjacent ejection portions and the electric lines of force to adjacent ink guides 84 are shielded by the guard electrode 96.

The guard electrode 96 is arranged in spaces between the first control electrodes 88 of adjacent ejection portions and suppresses the electric field interferences between the ink guides 84 of the adjacent ejection portions. FIGS. 4A, 4B, and 4C are respectively arrow views taken along the lines A—A, B—B, and C—C in FIG. 3B. As shown in FIG. 4A, the guard electrode 96 is a sheet-like electrode such as a metal plate that is common to every ejection portion, and holes are bored in the guard electrode 96 in portions corresponding to the first control electrodes 88 (respective ejection portions two-dimensionally arranged) formed around the through holes 98 (also see FIGS. 3A and 3B). Note that in this embodiment, the reason why the guard electrode 96 is provided is that if the ejection portions are arranged at a high density, there is a case where an electric field generated by an ejection portion is influenced by the states of electric fields generated by its adjacent ejection portions and therefore the size and drawing position of a dot ejected from the ejection portion fluctuate and recording quality is adversely affected.

By the way, the upper side of the guard electrode 96 shown in FIGS. 3A and 3B is covered with the insulation layer 94*c* except for the through holes 98 and the insulation layer 94*b* is disposed between the guard electrode 96 and the first control electrodes 88, thereby insulating the electrodes 96 and 88 from each other. That is, the guard electrode 96 is arranged between the insulation layer 94*c* and the insulation layer 94*b* and the first control electrodes 88 are arranged between the insulation layer 94*b* and the insulative substrate 86.

That is, as shown in FIG. 4B, on the upper surface of the insulative substrate 86, that is, between the insulation layer 94*b* and the insulative substrate 86, the first control electrodes 88 of the respective ejection portions formed around the through holes 98 are two-dimensionally arranged and are connected to each other in the row direction.

Also, as shown in FIG. 4C, on the upper surface of the insulation layer 94*a* (that is, on the lower surface of the insulative substrate 86), that is, between the insulation layer 94*a* and the insulative substrate 86 (see FIGS. 3A and 3B), the second control electrodes 90 of the respective ejection portions formed around the through holes 98 are two-dimensionally arranged and are connected to each other in the column direction.

Also, in this embodiment, in order to shield a repulsive electric field from the control electrode of each ejection portion (a repulsive electric field from each first control electrode 88 and each second control electrode 90) toward the ink flow path 100, a shield electrode may be provided on the flow path side of the first control electrode 88 and the second control electrode 90.

Further, in the ejection head 80 of this embodiment, the floating conduction plate 92 is provided which constitutes the undersurface of the ink flow path 100 and causes the positively charged ink particles (charged particles, that is, charged fine particle component) in the ink flow path 100 to migrate upwardly (that is, toward the recording medium P side) by means of induced voltages steadily generated by pulse voltages applied to the first control electrodes 88 and the second control electrodes 90. Also, an electrically insulative coating film (not shown) is formed on a surface of the floating conduction plate 92, thereby preventing a situation where the physical properties and components of the ink are destabilized due to charge injection into the ink or the like. It is preferable that the electric resistance of the insulative coating film be set at $10^{12}$ Ω·cm or higher, more preferably at $10^{13}$ Ω·cm or higher. Also, it is preferable that the insulative coating film is corrosion resistant to the ink, thereby preventing a situation where the floating conduction plate 92 is corroded by the ink. Further, the floating conduction plate 92 is covered with an insulation member from its bottom side. With this construction, the floating conduction plate 92 is completely electrically insulated and floated.

Here, at least one floating conduction plate 92 is provided for each ejection head unit. That is, in the ejection heads 80 for C, M, Y, and K, each head is provided with at least one floating conduction plate 92 and the ejection heads 80 for C and M will never share the same floating conduction plate.

In this embodiment, the circular electrodes are provided as the first control electrodes 88 and the second control electrodes 90 of the respective ejection portions and these electrodes are connected to each other in the row direction and the column direction. However, the present invention is not limited to this and all of the ejection portions may be separated from each other and driven independently of each other. Alternatively, one of the first control electrodes 88 and the second control electrodes 90 may be set as a sheet-like electrode common to every ejection portion (holes are bored in portions corresponding to the through holes 98).

Also, in this embodiment, the control electrodes are arranged so as to form the two-layered electrode structure composed of the first control electrodes 88 and the second control electrodes 90. However, the present invention is not limited to this and the control electrodes may be arranged so as to form a mono-layered electrode structure. In the case of the mono-layered electrode structure, it does not matter on which surface of the insulative substrate 86 the control electrodes are arranged, although it is preferable that the control electrodes be provided on the recording medium P side thereof. The ejection heads for the respective colors are constructed for example as described above.

Each of the ejection heads 80 is disposed so that its ejection portions are disposed in a direction perpendicular to a direction of conveyance of the recording medium P. Thus, the ejection heads 80 for the respective colors are disposed in a line along the direction of conveyance of the recording medium P. In addition, each of the ejection heads 80 is disposed so that its ejection portions for the ink are located in a position corresponding to a position of disposition of the conductive platen 36 and facing the surface of the conveyance belt 32, keeping a predetermined constant distance from a surface of the recording medium P which is conveyed by the conveyance belt 32 while being electrostatically attracted to the conveyance belt 30. In addition, the ejection portions of each of the ejection heads 80 may be disposed in a direction approximately parallel to the direction of conveyance of the recording medium P. In this case, serial scanning is carried out in which the following process is repeated. The ink droplets are ejected while the main scanning with the ejection head 80 is carried out in a direction perpendicular to the direction of conveyance of the recording medium P, and the recording medium P is then conveyed by a fixed amount.

As described above, the surface of the recording medium P which is electrostatically attracted to the conveyance belt 32 acting as the counter electrode is uniformly charged at a predetermined negative high electric potential by the charger 38 for the recording medium P, and thus is in a state where a constant D.C. bias voltage (about −1.5 kV) is always applied thereto. In addition, during recording, pulse voltages corresponding to image data are applied to the first control electrodes 88 and the second control electrodes 90 of the ejection portions of the ejection head 80 for each color by a pulse voltage applying device (not shown) for application of pulse voltages to the ink jet head 56 which will be described later.

In the ejection head 80 for each color, ink is ejected when high voltages (400 to 600 V) are applied as the pulse voltages in a state in which the constant D.C. bias voltage (about −1.5 kV) is always applied to the surface of the recording medium P. No ink is ejected when low voltages (0 V) are applied as the pulse voltages in that state. Thus, the ink ejected from the ejection head 80 for each color is attracted towards the surface of the recording medium P charged at the negative high electric potential to be stuck to the surface of the recording medium P, thereby recording a full-color image corresponding to the image data on the surface of the recording medium P.

Note that, in this embodiment, the constant D.C. bias voltage is always applied to the surface of the recording medium P which is electrostatically attracted to the conveyance belt 32 acting as the counter electrode, and during recording, the pulse voltages corresponding to the image data are applied to the control electrodes. However, the counter electrode side may be grounded, and constant D.C. bias voltages (e.g., 1.5 kV) may be always applied to the control electrode side of each of the ejection portions of the ejection head 80 for each color by the D.C. bias voltage applying device for application of voltages to the ink jet head 56 which will be described later.

As shown in FIG. 1, the ink circulation system 60 includes an ink tank 64, a pump (not shown), an ink supply passage 102 and an ink recovery passage 104. The ink tank 64 is disposed inside the casing 22 on its bottom face, and is connected to the ink jet head 56 through the ink supply passage 102 and the ink recovery passage 104.

The ink tank 64 holds ink for four colors each containing charged color fine particles for the corresponding color and a carrier liquid into which the charged color fine particles for each color are to be dispersed. The ink for each color held in the ink tank 64 is supplied to the ejection head 80 for each color in the ink jet head 56 through the ink supply passage 102 by the pump (not shown). In addition, the excessive ink for each color which was not used for recording an image is recovered by the pump (not shown) through the ink recovery passage 104 into the ink tank 64 for each color.

A carrier liquid replenishment tank 132 and a high concentration ink tank 134 are connected to the ink tank 64. The carrier liquid replenishment tank 132 is filled with a predetermined amount of a carrier liquid which will be described later, and the high concentration ink tank 134 is filled with a predetermined amount of concentrated ink. An ink replenishment amount adjusting device 130 can adjust at least one of an amount of the carrier liquid supplied from the carrier liquid replenishment tank 132 and an amount of the high concentration ink supplied from the high concentration ink tank 64 based on the ink concentration detected by the concentration detecting device 110 to be described below and the carrier liquid and/or the high concentration ink whose amounts have been adjusted are supplied to the ink tank 64 so that the ink in the ink tank 64 has desired ink concentration. In addition, when an amount of ink within the ink tank 64 decreases, the ink replenishment amount adjusting device 130 can control an amount of the carrier liquid supplied from the carrier liquid replenishment tank 132, and an amount of the high concentration ink supplied from the high concentration ink tank 134 to supply the carrier liquid and the high concentration ink to the ink tank 64. As a result, the concentration of the color particles contained in the ink can be held constant, and hence it is possible to suppress generation of bleeding, dropouts or squeezeout in a printed image, or a change in dot diameter.

In addition, as shown in FIG. 1, stirring means 136 and ink temperature control means 138 are provided within the ink tank 64. The stirring means 136 can suppress precipitation and concentration increase of the solid components such as the color particles contained in the ink within the ink tank 64. As a result, the necessity for cleaning the ink tank 64 can be reduced. As the stirring means 136, for example, a rotary blade, an ultrasonic transducer, a circulation pump or the like may be used, or a combination thereof may also be used.

The ink temperature control means 138 is provided in order to prevent physical properties of the ink from being changed due to a change in ambient temperature. As the ink temperature control means 138, for example, a heating element such as a heater, or a cooling element such as a Pertier element may be used.

Figure 5:
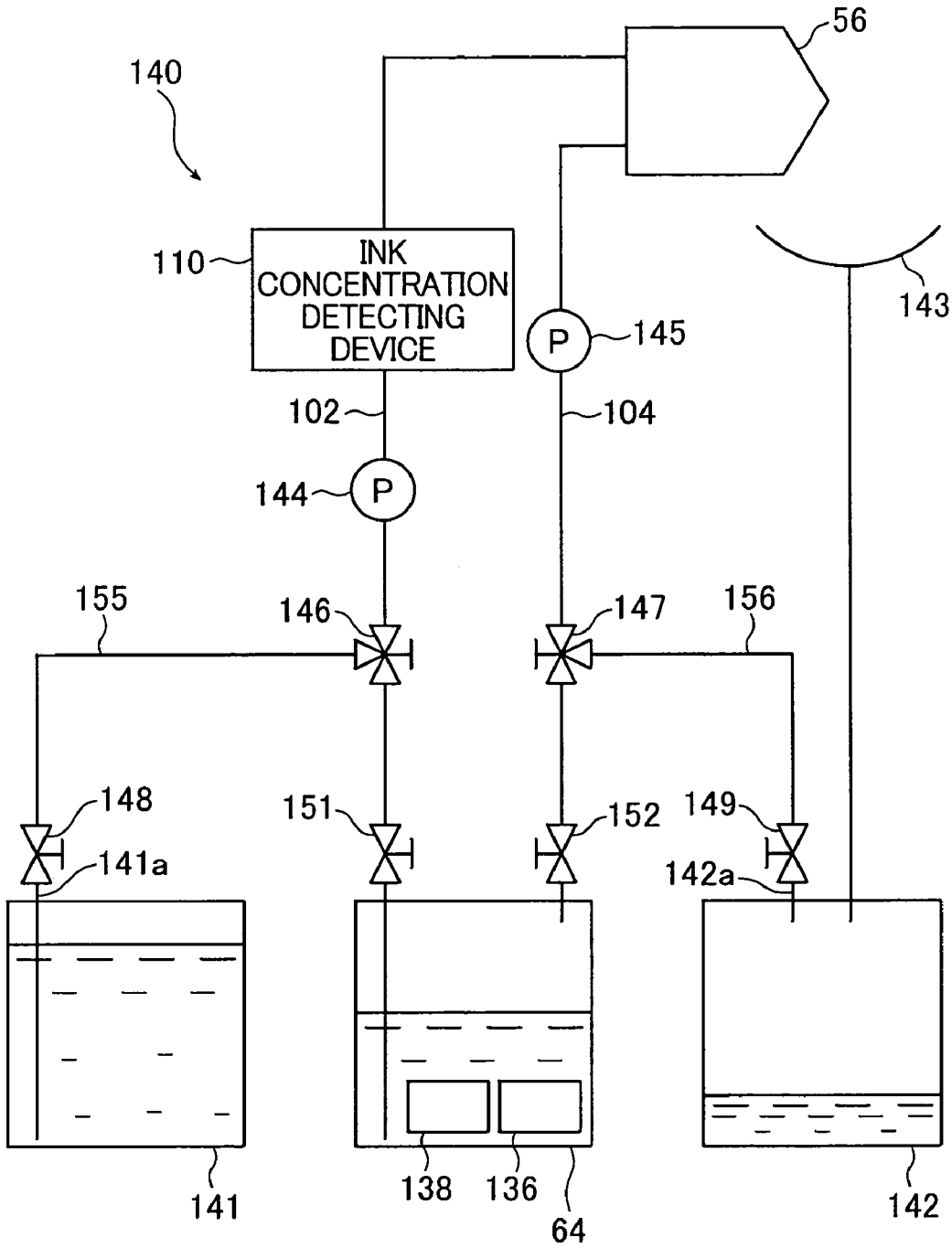
FIG. 5 is a schematic constructional view explaining a cleaning device of the ink jet recording device according to the present invention.

Next, a cleaning device for cleaning the insides of the ink supply passage 102 and the ink recovery passage 104, and the inside of the ink flow path of the ink jet head 56 will be described. A conceptual view of a cleaning device 140 is shown in FIG. 5. The cleaning device 140 mainly includes a cleaning liquid tank 141, a sump solution tank 142, a pan 143, a liquid feeding pump 144, a recovery pump 145, three-way valves 146 and 147, valves 148 and 149, and a control unit (not shown) for controlling opening/closing of the valves, and the pumps. The liquid feeding pump 144 supplies the ink from the ink tank 64.

The cleaning liquid tank 141 is for example filled with a predetermined amount of dielectric liquid suitably used as the carrier liquid which will be described later. A cleaning liquid feeding opening 141*a* of the cleaning liquid tank 141 is connected to the valve 148. The value 148 is connected to the three-way valve 146 through a supply passage 155 through which the cleaning liquid is to be supplied. In addition, a cleaning liquid recovery opening 142*a* of the sump solution tank 142 is connected to the valve 149. The valve 149 is connected to the three-way valve 147 through a recovery passage 156 through which the cleaning liquid having circulated in the ink jet head 56 and having been discharged therefrom is recovered.

Here, an operation of the cleaning device 140 will be described. The cleaning device 140 controls the valves 148 and 151, and the three-way valve 146 in the cleaning process using the control unit (not shown) to open the valve 148, close the valve 151 and switch the three-way valve 146 to a cleaning side. Moreover, the control unit is used to switch the three-way valve 147 to the sump solution tank 142 side and close the valve 152. As a result, after the cleaning liquid collected in the cleaning liquid tank 141 is sucked by driving the liquid feeding pump 144 and the recovery pump 145 and flown into the ink jet head 56 through the supply passage 155, the three-way valve 146, and the supply passage 102, the cleaning liquid passes through the recovery passage 104, the three-way valve 147, the valve 149, and the recovery passage 156 to be discharged into the sump solution tank 142.

When an amount of the cleaning liquid ejected is increased by controlling liquid feeding pressures in the liquid feeding pumps 144 and 145, the cleaning liquid leaks from the ejection portions of the ink jet head 56. However, the leaked cleaning liquid can be discharged into the sump solution tank 142 through the pan 143.

When the ink jet head 56 is driven to eject the ink in the ink tank 64, the control unit is used to close the valve 148, open the valve 151 and switch the three-way valve 146 to the ink tank 64 side. Moreover, the control unit is used to open the valve 152, close the valve 149, and switch the three-way valve 147 is to the ink tank 64 side. Thus, the ink in the ink tank 64 is supplied to the ink jet head 56 through the ink supply passage 102, and the excessive ink is recovered into the ink tank 64 through the recovery passage 104 by driving the liquid feeding pump 144 and the recovery pump 145.

Next, the ink concentration detecting device 110 of the ink jet recording apparatus 10 shown in FIG. 1 will be described.

As shown in FIG. 1, the ink concentration detecting device 110 mainly includes an ink concentration detecting section 112 and an ink concentration correcting section 114. The ink concentration detecting section 112 is provided in the middle of the ink supply passage 102 through which the ink is to be supplied from the ink tank 64 to the ink jet head 56. A detection portion of the ink supply passage where the ink concentration detecting section 112 detects the ink concentration is made of a material having a light transmitting property. The ink concentration detecting section 112 can detect the concentration of the ink passing through the ink supply passage 102 from the outside of the ink supply passage 102. As shown in FIG. 1, the ink concentration detecting device 110 is connected to the ink replenishment amount adjusting device 130.

Figure 6:
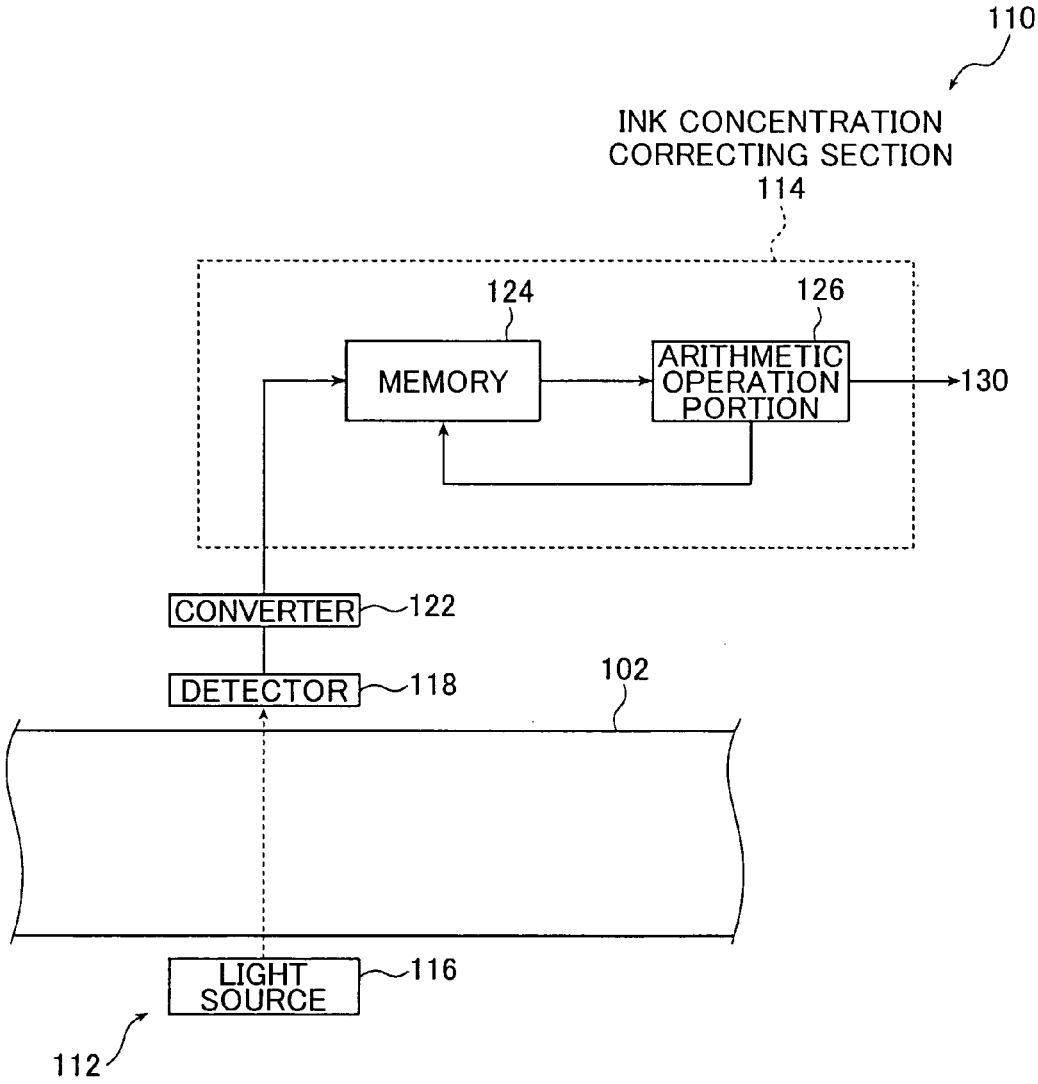
FIG. 6 is a block diagram showing a schematic configuration of an ink concentration detecting device in the ink jet recording apparatus according to the present invention.

The ink concentration detecting device 110 will hereinafter be described in more detail with reference to FIG. 6. FIG. 6 is a block diagram showing a schematic configuration of the ink concentration detecting device 110. The ink concentration detecting section 112 includes a light source 116, a detector 118, and a converter 122. The light source 116 and the detector 118 are disposed so that the ink supply passage 102 is interposed between the light source 116 and the detector 118. Thus, the light emitted from the light source 116 is transmitted through the ink supply passage 102 to be detected by the detector 118. As the light source 116, for example, an arbitrary light source such as a semiconductor laser or a light emitting diode may be used. An arbitrary device may be used as the detector 118 as long as this device can detect a quantity of light transmitted through the ink supply passage 102. The converter 122 includes a memory (not shown) in which a table is stored specifying a relationship between a quantity of transmitted light and an ink concentration value. The converter 122 can convert a quantity of transmitted light detected by the detector 118 into an ink concentration value by referring to this table.

The ink concentration correcting section 114 includes a memory 124 and an arithmetic operation portion 126. The arithmetic operation portion 126 can correct the concentration of the ink flowing through the inside of the ink supply passage 102 based on a detected value in an operation state which was obtained by the ink concentration detecting section 112, and a detected value in a cleaning state or a detected value which was obtained when the ink of known ink concentration was caused to flow in exchange of the ink. The detected value obtained in the cleaning state or the detected value which was obtained when the ink of the known ink concentration was caused to flow through the ink supply passage 102 is stored as a base line (reference value) in the memory 124. The arithmetic operation portion 126 corrects the detected value obtained by the ink concentration detecting section 112 based on the base line to thereby calculate the ink concentration.

Next, a method of detecting the concentration of ink flowing through the ink supply passage 102 using the ink concentration detecting device 110 will be described.

Figure 7:
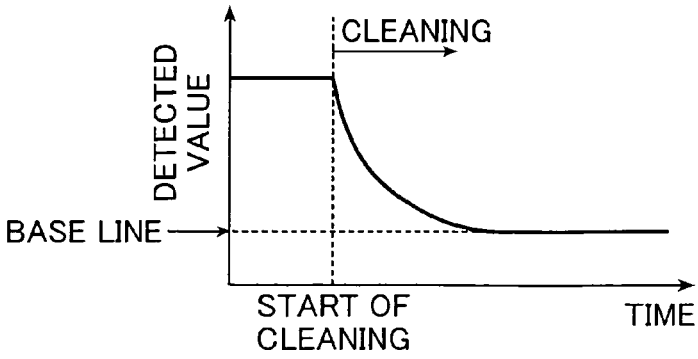
FIG. 7 is a graphical representation showing a relationship between a detected value obtained by an ink concentration detecting section of the ink concentration detecting device and a cleaning time when a cleaning liquid is caused to flow through a supply passage.

First of all, the above-mentioned cleaning device 140 is activated to supply the cleaning liquid to the ink supply passage 102 and the ink jet head 56. At this time, the color particles firmly adhered to the inner wall of the ink supply passage 102 are not perfectly removed, and hence some color particles are left adhered to the inner wall of the ink supply passage 102. After start of the cleaning, the ink concentration (second ink concentration) of the ink existing in the ink supply passage 102 in the cleaning state is detected by the ink concentration detecting section 112 while the cleaning liquid is supplied to the ink supply passage 102. FIG. 7 is a graphical representation showing a relationship between an elapsed time after start of the cleaning process and a detected value of the ink concentration. As shown in FIG. 7, even after a specified period of time has elapsed, the detected value does not become zero, but is saturated at a predetermined value. This means that the color particles which are still firmly adhered to the inner wall of the ink supply passage 102 are detected as the ink concentration component. Consequently, since the saturated detected value, i.e., the detected value obtained in the cleaning state corresponds to the ink concentration component of the color particles (contamination component) firmly adhered to the inner wall of the ink supply passage 102, this detected value is stored as the base line for correction of the ink concentration in the memory 124 of the ink concentration correcting section 114.

Next, the ink jet head 56 is operated to supply the ink to the ink supply passage 102, and in this state, the ink concentration detecting section 112 detects the ink concentration (first concentration) in the operation state from the outside of the ink supply passage 102, and the detected value in the operation state is then stored in the memory 124 of the ink concentration correcting section 114. The arithmetic operation portion 126 subtracts the value for the base line stored in the memory 124 from the detected value in the operation state, thereby correcting the concentration component of the color particles which are still firmly adhered to the inner wall of the ink supply passage 102. As a result, the ink concentration is precisely calculated. The calculated ink concentration value is precise ink concentration which is obtained by correcting the concentration component of the color particles still firmly adhered to the inner wall of the ink supply passage 102.

Then, the value of the ink concentration is inputted to the ink replenishment amount adjusting device 130. The ink replenishment amount adjusting device 130 determines an amount of high concentration ink which is to be supplied from the high concentration ink tank 134 shown in FIG. 1 to the ink tank 64 based on the ink concentration value and supplies high concentration ink to the ink tank 64. As a result, the ink in the ink tank 64 is set at a desired concentration value.

As described above, in this embodiment utilizing the cleaning liquid, the value of the ink concentration of the ink existing in the ink supply passage 102 after the cleaning liquid is caused to flow through the ink supply passage 102 to carry out the cleaning, i.e., when the detected value obtained in the ink concentration detecting section 112 comes into unchanged state (when saturated) is stored as the base line in the memory 124. Thus, the ink concentration of the ink existing in the ink supply passage is corrected using as the base line, the ink concentration due to the color particles (contamination component) firmly adhered to the inner wall of the ink supply passage 102.

In the above description, the detected value in the cleaning state in the ink supply passage 102 was obtained while the cleaning liquid is caused to flow. However, another process may also be adopted in which after completion of the cleaning, the detected value of the ink existing in the ink supply passage 102 is detected by the ink concentration detecting section 112 with the cleaning liquid being discharged from the ink supply passage 102, and this detected value is used as the base line. Even by using the base line obtained in such a manner, the precise ink concentration can be calculated which is obtained by correcting the concentration component of the color particles still firmly adhered to the inner wall of the ink supply passage 102.

Next, a method of calculating precise ink concentration by correcting the detected value in the operation state based on the detected value in a state in which the ink of known ink concentration is used will be described.

First of all, the ink of known ink concentration is caused to flow through the ink supply passage 102 to detect the concentration of the ink flowing through the ink supply passage 102 from the outside of the ink supply passage 102 by the ink concentration detecting section 112, and the resultant detected value is stored in the memory 124 of the ink concentration correcting section 114. The value of the known concentration of the ink which was caused to flow through the ink supply passage 102 is also stored in the memory 124. Then, the value of the known ink concentration is compared with the detected value obtained by the ink concentration detecting section 112 in the arithmetic operation portion 126. At this time, if no color particle is firmly adhered to the inner wall of the ink supply passage 102, then the detected value obtained by the ink concentration detecting section 112 agrees with the value of the known ink concentration. Hence, in this case, the detected value obtained by the ink concentration detecting section 112 is calculated as the real ink concentration.

On the other hand, when the detected value obtained by the ink concentration detecting section 112 is larger than the value of the known ink concentration, this case corresponds to a case where the color particles are firmly adhered to the inner wall of the ink supply passage 102, and thus the value of the ink concentration component due to such color particles is contained in the detected value obtained by the ink concentration detecting section 112. In this case, the arithmetic operation portion 126 of the ink concentration correcting section 114 compares the detected value in the operation state obtained by the ink concentration detecting section 112 with the value of the known ink concentration to calculate the value of the ink concentration component due to the color particles firmly adhered to the inner wall of the ink supply passage 102. Then, the value of the ink concentration component due to those color particles is stored in the memory 124 as the base line for correction of the ink concentration. When the ink concentration is actually detected, the detected value in the operation state obtained by the ink concentration detecting section 112 is corrected based on the base line. In such a manner, the arithmetic operation portion 126 can calculate the precise ink concentration which is obtained by correcting the ink concentration component due to the color particles firmly adhered to the inner wall of the ink supply passage 102.

The method of determining the ink concentration component due to the color particles firmly adhered to the inner wall of the ink supply passage 102 from the known ink concentration is an effective method in a case where the ink is totally exchanged for another.

When the ink of the known ink concentration is used as described above, the ink concentration component (contamination component) due to the color particles firmly adhered to the inner wall of the ink supply passage 102 is calculated based on the relationship between the value of the optical concentration on the ink of the known ink concentration which is previously stored in the memory 124, and the actually detected value obtained by the ink concentration detecting section 112 and the ink concentration of the ink existing in the ink supply passage in the operation state (the first ink concentration) is corrected.

In this embodiment, the concentration of the ink is detected from the light which is transmitted through the ink supply passage 102. However, it is also possible to use another method in which light is made incident on the ink supply passage, and the light reflected by the ink supply passage is then captured by a detector to detect the concentration of the ink existing in the ink supply passage based on the optical reflectance. Alternatively, there may also be adopted a method in which an amount of color particles firmly adhered to the inner wall of the ink supply passage is detected by utilizing a change in electrical resistance or a magnetic change to thereby obtain the ink concentration based on the color particles firmly adhered to the inner wall of the ink supply passage.

In addition, while in this embodiment, the ink concentration detecting section 112 of the ink concentration detecting device 110 is provided on the ink supply passage 102, the present invention is not intended to be limited to this construction. Thus, the ink concentration detecting device 110 may be provided in an arbitrary portion as long as the ink can be supplied to the ink jet head through this portion. For example, the ink concentration detecting device 110 may also be provided in the ink recovery passage.

In addition, while in this embodiment, the ink concentration detecting section 112 of the ink concentration detecting device 110 is provided outside the ink supply passage 102, the ink concentration detecting section 112 may also be provided inside the ink supply passage 102. In this case, since measurement components or parts of the ink concentration detecting section 112 directly contact the ink, the ink concentration of the ink adhered to those measurement components or parts has only to be detected to correct the detected value in the operation state. More specifically, similarly to the above, since the detected value obtained by the ink concentration detecting section 112 while the cleaning liquid is caused to flow through the ink supply passage 102, or after completion of the flowing of the cleaning liquid corresponds to the ink concentration due to the color particles adhered to those measurement components or parts of the ink concentration detecting section 112, the detected value obtained in the operation state is corrected using the detected value as the base line. Alternatively, the detected value obtained in the operation state may also be corrected based on the detected value which was obtained in the ink concentration detecting section while the ink of known ink concentration was caused to flow through the ink supply passage 102. In addition, the ink concentration detecting section 112 may be disposed in any position as long as this position is located in the ink flow path. For example, the ink concentration detecting section 112 may be disposed in the ink recovery passage 104, the ink flow path in the ink jet head 56, or the ink tank 64 instead of the ink supply passage 102.

Next, the position detector 62 for the recording medium P will be described.

The position detector 62 for detecting a position of the recording medium P is conventionally known position detection means composed of a photo-sensor or the like. The position detector 62 is disposed in a position between the charger 38 and the ink jet head 56 along the conveyance path for the recording medium P. In this case, this position where the position detector 62 is disposed faces the surface of the conveyance belt 32 by which the recording medium P is conveyed.

A position of the recording medium P is detected by the position detector 62, and the resultant positional information is supplied to the head driver 58.

The head driver 58 is installed inside the casing 22 on its right-hand surface in FIG. 1, and is connected to the ink jet head 56.

The image data from an external device as well as the positional information of the recording medium P from the position detector 62 are inputted to the head driver 58. The ink of each color is ejected from each ejection head for each color based on image data while the ejection timing of each ejection head of the ink jet head 56 is controlled based on the positional information of the recording medium P with the control made by the head driver 58. Thus, a full-color image corresponding to the image data is recorded on the recording medium P.

That is to say, the full-color printing is carried out for the recording medium P by the recording means 16 to record the full-color image on the recording medium P while the recording medium P is conveyed at a predetermined speed in front of the ink jet head 56 by the conveyance means 14.

Subsequently, the solvent collection means 18 will be described.

The solvent collection means 18 recovers the carrier liquid evaporating from the ink ejected from the ink jet head 56 onto the recording medium P, the carrier liquid evaporating from the ink during image fixation, and the like. The solvent collection means 18 includes an exhaust fan 70 and an activated carbon filter 68. The activated carbon filter 68 is mounted on an upper rear surface of the casing 22, and the exhaust fan 70 is mounted onto the activated carbon filter 68.

The air containing the carrier liquid components in the casing 22 is exhausted to the outside of the casing 22 through the activated carbon filter 68 by the exhaust fan 70. During the exhaust of the air, the carrier liquid components contained in the air in the casing 22 are attracted and removed by the activated carbon filter 68.

Next, ink used in the ink jet recording apparatus according to the present invention will be described.

As described above, ink Q (ink composition) used in the present invention is obtained by dispersing color particles (charged fine particles which contain colorants) in a carrier liquid.

In addition, dispersion resin particles for enhancement of the fixing property of an image after completion of the printing may be contained as appropriate in the ink Q together with the color particles.

The carrier liquid is preferably a dielectric liquid (non-aqueous solvent) having a high electrical resistivity (equal to or larger than $10^9$ Ω·cm, and more preferably equal to or larger than $10^{10}$ Ω·cm). If the electrical resistance of the carrier liquid having a low electrical resistivity is low, the concentration of the color particles does not occur since the carrier liquid itself receives the injection of the electric charges to be charged due to a voltage applied from control electrodes as will be described later. In addition, since there is also anxiety that the carrier liquid having a low electrical resistivity causes the electrical conduction between the adjacent control electrodes, the carrier liquid having a low electrical resistivity is unsuitable for the present invention.

A relative permittivity of the dielectric liquid used as the carrier liquid is preferably equal to or smaller than 5, more preferably equal to or smaller than 4, and much more preferably equal to or smaller than 3.5. Such a range is selected for the relative permittivity, whereby the electric field effectively acts on the color particles contained in the carrier liquid to facilitate the electrophoresis of the color particles.

Note that an upper limit of the specific electrical resistance of such a dielectric liquid is desirably about $10^{16}$ Ω·cm, and a lower limit of the relative permittivity is desirably about 1.9. The reason why the electrical resistance of the dielectric liquid preferably falls within the above-mentioned range is that if the electrical resistance becomes low, then the ejection of the ink under a low electric field becomes worse. Also, the reason why the relative permittivity preferably falls within the above-mentioned range is that if the relative permittivity becomes high, then the electric field is relaxed due to the polarization of the solvent, and as a result the color of dots formed under this condition becomes light, or the bleeding occurs.

Preferred examples of the dielectric liquid used as a carrier liquid include straight-chain or branched aliphatic hydrocarbons, alicyclic hydrocarbons, aromatic hydrocarbons, and the same hydrocarbons substituted with halogens. Specific examples thereof include hexane, heptane, octane, isooctane, decane, isodecane, decalin, nonane, dodecane, isododecane, cyclohexane, cyclooctane, cyclodecane, benzene, toluene, xylene, mesitylene, Isopar C, Isopar E, Isopar G, Isopar H, Isopar L, Isopar M (Isopar: a trade name of EXXON Corporation), Shellsol 70, Shellsol 71 (Shellsol: a trade name of Shell Oil Company), AMSCO OMS, AMSCO 460 Solvent, (AMSCO: a trade name of Spirits Co., Ltd.), a silicone oil (such as KF-96L, available from Shin-Etsu Chemical Co., Ltd.). The dielectric liquid may be used singly or as a mixture of two or more thereof.

For such color particles dispersed in the carrier liquid, colorants themselves may be dispersed as the color particles into the carrier liquid. Alternatively, the color particles may also be contained in dispersion resin particles for enhancement of fixing property. In the case where the colorants are contained in the dispersion resin particles, in general, there is adopted a method in which the pigments or the like are covered with the resin material of the dispersion resin particles to obtain the particles covered with the resin, and the dispersion resin particles are colored with the dyes or the like to obtain the color particles.

As the colorants, the ink composition for ink jet recording, the (oily) ink composition for printing, and the pigments and dyes used in the liquid developer for electrostatic photography may be all used as in the past.

In the ink Q, a content of color particles (a total content of color particles and dispersion resin particles) preferably falls within a range of 0.5 to 30.0 wt % for the overall ink, more preferably falls within a range of 1.5 to 25.0 wt %, and much more preferably falls within a range of 3.0 to 20.0 wt %. If the content of color particles decreases, the following problems become easy to arise. The density of the printed image is insufficient, the affinity between the ink Q and the surface of the recording medium P becomes difficult to be obtained to disable the image firmly adhered to the surface of the recording sheet from being obtained, and so forth. On the other hand, if the content of color particles increases, problems occur in that the uniform dispersion liquid becomes difficult to obtain, the clogging of the ink Q is easy to occur in the ink jet head 10 or the like to make it difficult to obtain the stable ink ejection, and so forth. The reason why the above-mentioned range is selected for the content of color particles is to prevent those problems from arising.

Pigments used as colorants may be inorganic pigments or organic pigments commonly employed in the field of printing technology. Specific examples thereof include but are not particularly limited to known pigments such as carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanine pigments, quinacridone pigments, isoindolinone pigments, dioxazin pigments, threne pigments, perylene pigments, perynone pigments, thioindigo pigments, quinophthalone pigments, and metal complex pigments.

Preferred examples of dyes used as colorants include oil-soluble dyes such as azo dyes, metal complex salt dyes, naphthol dyes, anthraquinone dyes, indigo dyes, carbonium dyes, quinonimine dyes, xanthene dyes, aniline dyes, quinoline dyes, nitro dyes, nitroso dyes, benzoquinone dyes, naphthoquinone dyes, phthalocyanine dyes, and metal phthalocyanine dyes.

In addition, an average particle diameter of the color particles dispersed in the carrier liquid preferably falls within a range of 0.1 to 5.0 μm, more preferably falls within a range of 0.2 to 1.5 μm, and much more preferably falls within a range of 0.4 to 1.0 μm. Those particle diameters are measured with CAPA-500 (a trade name of a measuring apparatus manufactured by HORIBA LTD.).

After the color particles are dispersed in the carrier liquid, a charging control agent is added to the resultant carrier liquid to charge the color particles, and the charged color particles are dispersed in the resultant liquid to thereby produce the ink Q. Note that in dispersing the color particles in the carrier liquid, a dispersion medium may be added if necessary.

As the charging control agent, for example, various ones used in the electrophotographic liquid developer can be utilized. In addition, it is also possible to utilize various charging control agents described in "DEVELOPMENT AND PRACTICAL APPLICATION OF RECENT ELECTRONIC PHOTOGRAPH DEVELOPING SYSTEM AND TONER MATERIALS", pp. 139 to 148; "ELECTROPHOTOGRAPHY-BASES AND APPLICATIONS", edited by THE IMAGING SOCIETY OF JAPAN, and published by CORONA PUBLISHING CO. LTD., pp. 497 to 505, 1988; and "ELECTRONIC PHOTOGRAPHY" by Yuji Harasaki, 16(No. 2), p. 44, 1977.

Note that the color particles may be positively or negatively charged as long as the charged color particles are identical in polarity to the drive voltages applied to the control electrodes.

In addition, a charging amount of color particles is preferably in a range of 5 to 200 μC/g, more preferably in a range of 10 to 150 μC/g, and much more preferably in a range of 15 to 100 μC/g.

In addition, the electrical resistance of the dielectric liquid may be changed by adding the charging control agent in some cases. Thus, a distribution factor P defined below is preferably equal to or larger than 50%, more preferably equal to or larger than 60%, and much more preferably equal to or larger than 70%.

$$P=100\times(\sigma1-\sigma2)/\sigma1$$

where σ1 is an electric conductivity of the ink Q, and σ2 is an electric conductivity of a supernatant liquid which is obtained by inspecting the ink Q with a centrifugal separator. Those electric conductivities were obtained by measuring the electric conductivities of the ink Q and the supernatant liquid under a condition of an applied voltage of 5 V and a frequency of 1 kHz using an LCR meter of an AG-4311 type (manufactured by ANDO ELECTRIC CO., LTD.) and electrode for liquid of an LP-05 type (manufactured by KAWAGUCHI ELECTRIC WORKS, CO., LTD.). In addition, the centrifugation was carried out for 30 minutes under a condition of a rotational speed of 14,500 rpm and a temperature of 23° C. using a miniature high speed cooling centrifugal machine of an SRX-201 type (manufactured by TOMY SEIKO CO., LTD.).

The ink Q as described above is used, which results in that the color particles are likely to migrate and hence the color particles are easily concentrated.

The electric conductivity of the ink Q is preferably in a range of 100 to 3,000 pS/cm, more preferably in a range of 150 to 2,500 pS/cm, and much more preferably in a range of 200 to 2,000 pS/cm. The range of the electric conductivity as described above is set, resulting in that the applied voltages to the control electrodes are not excessively high, and also there is no anxiety to cause the electrical conduction between the adjacent control electrodes.

In addition, a surface tension of the ink Q is preferably in a range of 15 to 50 mN/m, more preferably in a range of 15.5 to 45.0 mN/m, and much more preferably in a range of 16 to 40 mN/m. The surface tension within this range permits the applied voltages to the control electrodes from being excessively high and also the ink from leaking and spreading to the periphery of the head thus contaminating the head.

Moreover, a viscosity of the ink Q is preferably in a range of 0.5 to 5.0 mPa·sec, more preferably in a range of 0.6 to 3.0 mPa·sec, and much more preferably in a range of 0.7 to 2.0 mPa·sec.

Note that in the present invention, the process is not adopted in which the force is caused to act on the overall ink to fly the ink towards the recording medium as in a conventional ink jet system, but the process is adopted in which the force is caused to mainly act on the color particles as the solid components which are dispersed into the carrier liquid to fly the ink droplet containing the color particles.

As a result, images can be recorded on various recording media P such as a non-absorption film (e.g., a PET film) and plain paper. In addition, images of high quality can be obtained for the various recording media P without causing bleeding or flowing.

The operation of the electrostatic type ink jet recording apparatus 10 will hereinafter be described.

In the electrostatic type ink jet apparatus 10, in recording an image, the recording media P accommodated in the sheet feeding tray 24 are taken out one by one by the feed roller 26 to be held and conveyed by the conveyance roller pair 30. Each sheet of the recording medium P thus conveyed is then supplied to a predetermined position on the conveyance belt 32.

The recording medium P supplied to the conveyance belt 32 is then charged at a negative high voltage by the charger 38 to be electrostatically attracted on the surface of the conveyance belt 32.

An image corresponding to the image data is recorded by the ink jet head 56 on the surface of the recording medium P which is electrostatically attracted on the surface of the conveyance belt 32, while the recording medium P is moved at a predetermined constant speed along with the movement of the conveyance belt 32.

The recording medium P after the image has been recorded thereon is discharged by the discharger 40, and is then separated from the conveyance belt 32 by the separation claw 42 to be supplied to the fixing roller pair 46 along the guide 44. Then, the recorded image on the recorded medium P is heated and fixed while the recording medium P is held and conveyed by the fixing roller pair 46. The resultant sheets each having an image recorded thereon are stocked on top of one another within the discharge tray 28.

The ink replenishment amount adjusting device 130 determines amounts of replenishment of the high concentration ink and the carrier liquid based on at least one of the ink concentration detected by the ink concentration detecting device 110 and an amount of ink within the circulation system to replenish the ink tank with the carrier liquid and the high concentration ink from the carrier liquid replenishment tank 132 and the high concentration ink tank 134.

The present invention is basically as described above.

While the ink concentration detecting method has been described in detail, it is to be understood that the present invention is not intended to be limited to the above-mentioned embodiment, and hence the various improvements and changes may be made without departing from the subject matter of the invention.

What is claimed is:

1. An ink jet recording apparatus, comprising:

ink jet ejecting means for ejecting ink containing charged color particles towards a recording medium by an electrostatic force;

ink supplying means for supplying said ink to said ink jet ejecting means;

detection means for detecting ink concentration as concentration of said color particles, said detection means being provided in an ink passage of said ink; and ink concentration correcting means for correcting a detected value in an operation state in said ink passage obtained by said detection means based on one of a detected value obtained in a cleaning state in said ink passage using a cleaning liquid and a detected value obtained in a using state in which ink of known ink concentration is used.

2. The ink jet recording apparatus according to claim 1, wherein said detected value obtained in the cleaning state is a detected value obtained by said detection means when the cleaning liquid is caused to flow through said ink passage or after the cleaning liquid is caused to flow through said ink passage, and the detected value obtained in the using state in which the ink of known ink concentration is used is a detected value obtained by said detection means when the ink of known ink concentration is caused to flow through said ink passage in ink exchange.

3. The ink jet recording apparatus according to claim 1, further comprising cleaning means for cleaning said ink passage using the cleaning liquid.

4. The ink jet recording apparatus according to claim 1, wherein said ink of known concentration is one of fresh ink of predetermined concentration which is to be caused to flow in ink exchange and a diluted liquid of low ink concentration, and said cleaning liquid is one of a carrier liquid for the color particles contained in the ink and a diluted liquid containing no color particle.

5. The ink jet recording apparatus according to claim 1, wherein said detection means optically detects said ink concentration in said ink passage.

6. The ink jet recording apparatus according to claim 1, wherein said ink passage is formed of a tubular member, and wherein said detection means optically detects said ink concentration in said ink passage from outside said tubular member.

7. An ink concentration detecting method in which concentration of ink containing charged color particles and supplied to an ink jet head for ejecting the ink towards a recording medium by an electrostatic force is detected, comprising the steps of:

causing one of a cleaning liquid and ink of known ink concentration to flow through an ink passage through which the ink is to flow;

detecting a first ink concentration in said ink passage in an operation state in which ink of predetermined ink concentration flows through said ink passage;

detecting a second ink concentration in said ink passage after said cleaning liquid is caused to flow through said ink passage to clear said ink passage or in a state in which said ink of known ink concentration is caused to flow through said ink passage; and detecting ink concentration in said ink passage in said operation state based on said first ink concentration and said second ink concentration.

* * * * *